United States Patent [19]

Potts et al.

[11] Patent Number: 4,965,000

[45] Date of Patent: Oct. 23, 1990

[54] FABRIC SOFTENER COMPOSITION AND LAUNDRY CLEANING ARTICLE CONTAINING SAME

[75] Inventors: David C. Potts, Marietta, Ga.; Maug H. Win, Neenah; Lee P. Garvey, Little Chute, both of Wis.

[73] Assignee: Kimberly-Clark Corporation, Neenah, Wis.

[21] Appl. No.: 376,064

[22] Filed: Jul. 5, 1989

[51] Int. Cl.[5] ..... D06M 15/00

[52] U.S. Cl. ..... 252/8.75; 252/8.6; 252/8.7; 252/8.8; 252/91; 428/279

[58] Field of Search ..... 252/90, 91, 8.6, 8.8, 252/8.75; 428/310, 262, 242; 427/242

[56] References Cited

U.S. PATENT DOCUMENTS

| | | | |
|---|---|---|---|
| 3,936,537 | 2/1976 | Baskerville, Jr. | 427/242 |
| 3,954,630 | 5/1976 | Ramachandran | 252/8.6 |
| 4,057,673 | 11/1977 | Falivene | 428/111 |
| 4,076,633 | 2/1978 | Edwards et al. | 252/8.75 |
| 4,095,946 | 6/1978 | Jones et al. | 8/137 |
| 4,113,630 | 9/1978 | Hagner et al. | 252/8.6 |
| 4,118,525 | 10/1978 | Jones | 427/242 |
| 4,184,970 | 1/1980 | Draper, Jr. | 252/8.8 |
| 4,203,851 | 5/1980 | Ramachandran | 252/8.6 |
| 4,213,867 | 7/1980 | Cukier et al. | 252/8.75 |
| 4,234,627 | 11/1980 | Schilling | 427/242 |
| 4,259,373 | 3/1981 | Demessemaekers et al. | 427/242 |
| 4,265,772 | 5/1981 | Jones | 252/8.6 |
| 4,272,386 | 6/1981 | Draper, Jr. et al. | 252/8.6 |
| 4,401,578 | 8/1983 | Verbruggen | 252/8.8 |
| 4,426,299 | 1/1984 | Verbruggen | 252/8.8 |

*Primary Examiner*—Paul Lieberman
*Assistant Examiner*—John F. McNally
*Attorney, Agent, or Firm*—Gregory E. Croft

[57] ABSTRACT

A fabric softener composition, which can pass through the wash cycle of a clothes washer, comprises a fabric softener, polystyrene, a plasticizer, and a long chain alcohol. The fabric softener composition is particularly suitable in combination with a web substrate, preferably a web substrate containing liquid laundry detergent to provide a single product for washing and softening clothes.

29 Claims, No Drawings

FABRIC SOFTENER COMPOSITION AND LAUNDRY CLEANING ARTICLE CONTAINING SAME

BACKGROUND OF THE INVENTION

The current trend in laundry cleaning products is to provide both cleaning and fabric softening with a single product. Such products have a great deal of appeal to consumers because of their convenience. Although there are several products of this type on the market, there is still a need for a convenient, neat, and relatively inexpensive product which incorporates a liquid laundry detergent and a fabric softener. Such a product can be added to the washer and be carried through the drying cycle, with the fabric softener being released when the product is exposed to the drying cycle.

SUMMARY OF THE INVENTION

In one aspect, the invention resides in a fabric softener composition comprising a fabric softener, polystyrene, a plasticizer, and a long chain alcohol. Compositions of this invention are solid at room temperature and will not dissolve in water at laundry washing temperatures. However, at the higher temperatures encountered in clothes dryers, the compositions soften and fabric softener is released to the clothes.

In another aspect, the invention resides in a laundry cleaning product comprising a substrate supporting a coating of the fabric softener composition described above. The coating can be continuous or discontinuous, and preferably is applied by printing the fabric softener composition on the surface of the substrate in a suitable pattern. Preferably the substrate contains an amount of laundry detergent sufficient to wash a load of laundry, thus providing washing and softening functions within a single product. In such embodiments, it is preferable to impregnate the substrate with liquid laundry detergent in distinct areas and apply the fabric softener composition to untreated areas of the web where substantially no liquid detergent is present. This enables the fabric softener composition to more securely bond to the substrate, thus preventing release during the wash cycle, which might happen if the fabric softener composition were coated on top of the liquid laundry detergent-treated areas of the substrate. Alternatively, a multi-ply substrate can be employed, in which one ply or layer contains detergent and another ply contains fabric softener composition.

A most preferred embodiment of a product in accordance with this invention comprises a meltblown web saturated with laundry detergent in parallel strips about 2–3 inches wide and spaced apart by about ½–¾inch. The fabric softener is applied to the inbetween areas to enable it to bind securely and directly to the fabric. Thus, the web has alternating strips of detergent and fabric softener composition.

The fabric softener component of the fabric softener composition can be any fabric softener which exerts a softening activity in a clothes dryer. Suitable fabric softening agents include those described in U.S. Pat. No. 3,686,025 to Morton, dated Aug. 22, 1972. Normally such materials are cationic and of the cationic compounds the quaternary nitrogen-containing compounds, such as quaternary ammonium salts, are preferred. The softening agent, which is also usually an anti-static agent, will preferably be one which is normally (at room temperature) solid and becomes semi-solid or liquid in a clothes dryer environment.

Although amphoteric softening agents may be employed, such as dialkyl glycines, which include higher fatty acyl dimethyl glycine and higher fatty acyl amidopropyl dimethyl glycine wherein the higher fatty acyl is of 10 to 14 carbon atoms, e.g., the coconut oil fatty acids, the tallow fatty acids and the hydrogenated tallow fatty acids compounds, normally it will be highly preferred to utilize cationic softeners. These include quaternary ammonium salts which will usually contain a plurality of lower alkyl groups and one or two higher alkyl, benzyl or equivalent groups on the quaternary nitrogen and wherein the salt-forming ion will preferably be chloride or methyl sulfate (or methosulfate), although bromide and ethyl sulfate may also be used, as may be any other suitable anion. The useful quaternary ammonium salts will usually be of the formula $[R_1R_2R_3R_4N]^+ X^-$, wherein $R_1$ is an organic radical which includes a monovalent aliphatic group, an alkylphenol or an alkylbenzyl group of 8 to 22 carbon atoms in the alkyl chain, $R_2$ and $R_3$ each represent hydrocarbyl groups containing from 1 to 4 carbon atoms or $C_{2-4}$ hydroxyalkyl groups and cyclic structures in which the hydrogen atom is in the ring, $R_4$ is a monovalent organic group of a type like $R_1$, $R_2$ or $R_3$ and X is an anion, preferably chloride, bromide or methyl sulfate. Although not indicated in the above formula, $R_1$ and/or $R_4$ may be attached to the quaternary nitrogen atom through an ether, alkoxy, ester or amide linkage. Other quaternary ammonium compound softeners which are useful in practicing the invention are imidazolinium compounds wherein substituted on the ring and on the amide carbon are one or more higher alkyl groups having 8 to 22 carbon atoms. Preferably, in the quaternary ammonium salt formula given, the aliphatic substituents are alkyl or monoalkenyl groups of 12 to 22, more preferably 16 to 22 carbon atoms and the alkyl moieties of the alkylphenol or alkylbenzyl are of 8 to 18, preferably 10 to 16, carbon atoms. Most preferably, the lower alkyl groups of $R_2$ and $R_3$ are methyl and X is methyl sulfate (although chloride and bromide are often equally good). In the imidazolinium compounds the alkyl group is preferably of 16 to 20 carbon atoms.

Within the more general description of cationic softening agents given above, preferred softeners may be selected from the group consisting of dimethyl higher alkyl benzyl ammonium chlorides, trimethyl higher alkyl ammonium chlorides, trimethyl higher alkyl ammonium methyl sulfates, dimethyl di-higher alkyl ammonium chlorides, dimethyl di-higher alkyl ammonium methyl sulfates, monomethyl tri-higher alkyl ammonium chlorides, methyl dialkoxy higher alkyl ammonium chlorides, methyl dialkoxy higher alkyl ammonium methyl sulfates, methyl dialkoxy higher alkyl ammonium ethyl sulfates, pentamethyl higher alkyl propane diammonium dichlorides and higher alkyl imidazolinium methyl sulfates, wherein higher alkyl is of 8 to 22 carbon atoms and alkoxy is of a unit of 2 to 3 carbon atoms, with 1 to 50 thereof being present per alkoxy. For example, in the above compounds the alkyl may be stearyl or cetyl, the alkoxy may be ethoxy and the number of ethoxies may be about 20.

Preferred specific cationic softening agents utilized in the present invention include di-hydrogenated tallow dimethyl ammonium methyl sulfate; di-hydrogenated tallow dimethyl ammonium chloride; and 1-methyl-1-alkylamidoethyl-2-alkylimidazolinium methyl sulfate wherein the "alkyls" are oleyl or saturated hydrocarbyls derived from tallow or hydrogenated tallow. Dimethyl alkyl benzyl quaternaries that are useful include those wherein the alkyl group is of a mixture of alkyls of 10 to 18 carbon atoms or 12 to 16 carbon atoms, e.g., lauryl, myristyl and palmityl. The various mentioned materials are available commercially from various manufacturers, those from Sherex Chemical Company being identified by tradenames such as Adogen (415; 432; 434; 436; 441; 442; 444; 461; 462; 464; 471; 477; and R-6); Arosurf (TA-100; TA-101); Variquat (638; 50MC; 60LC; 80MC; A200; B200; C75; E228; K75; K300; LC80); and Varisoft (110; 136; 137; 190; 204-90; 208-90; 222; 222-90; 238; 238-90; 299; 472; 475; 3690; 6112; SDC; and SDC-W).

The polystyrene component of the fabric softener composition can be characterized by having melt flows above 2.0 grams in 10 min. These materials or materials similar to these polystyrene materials that would be available from various manufacturers such as Amoco Chemical Company, 200 E. Randolph Dr., Chicago, Ill. 60601; Arco Chemical Company, 1500 Market St., Philadelphia, Pa. 19102; Chevron Chemicals Corporation, P.O Box 1563, Houston, Tex. 77251 (identified by tradenames such as MC 3100; MA 3200; MC 3500; MC 3600; MC 3700); and Huntsman Chemical Corp., Plastics Div., 5100 Bainbridge Blvd., Chesapeake, Va. 23320 (identified by tradenames such as PS 203; PS 202; PS 206; PS 208; PS 210 and PS 230).

The plasticizer component of the fabric softener composition can be any of a variety of esters. Many of the commercially available plasticizers for polystyrene are esters of mono- or polycarboxylic acids. A partial list of suitable acids which, when converted to esters, can be used as plasticizers for polystyrene include abietic acid, adipic acid, azelaic acid, benzoic acid, fumaric acid, glutaric acid, isobutyric acid, myristic acid, oleic acid, phosphoric acid, phtalic acid and steric acid. These acids can be esterified with a variety of alcohols, including alkyl alcohols having from 4 to 9 carbon atoms. For instance, adipic acid can be esterified with a variety of alcohols. Methanol, ethanol and propanol have not been shown to make effective esters, but butanol, isobutanol and hexanol make esters that are useful as plasticizers for polystyrene. Octanol, when esterified with adipic acid to form dioctyl adipate (DOA) renders the most preferred ester for purposes of this invention. Also preferred are diisooctyl adipate (DIOA) and di-(2-ethylhexyl) adipate. These are available from C. P. Hall Company, being identified by tradenames such as PlastHall DOA and PlastHall DIOA. In addition, there are several kinds of nonesters that can also be of use. They are the chlorinated paraffins and several kinds of aromatic hydrocarbons. The phthalic esters and aromatic hydrocarbons, although technically feasible, are not recommended because some members may be carcinogenic.

The long chain alcohol component of the fabric softener composition can be any long chain branched primary alcohol. Those alcohols having a chain length of 14 or more carbon atoms are preferred because of their high flash points and economical availability. Alcohols having chain lengths between 8 and 14 tend to be more expensive, and those having a chain length of less than 8 carbons have too high of a flash point to be practical. An example of these branched alcohols is isostearyl alcohol, which has a methyl group in the alpha position. Isostearyl alcohol is sold by Sherex Chemical Company, P.O. Box 646, Dublin, Ohio 43017 and sold under the tradename Adol 66. Other branched alcohols that are of value for use with this invention are straight-chain or normal alcohols substituted in the 2-position with an alkyl group. These alcohols include the class of branched alcohols identified as Guerbet alcohols. Examples of Guerbet alcohols include, by way of illustration only, 2-butyloctanol, 2-pentylnonenol, 2-hexyldecanol, 2-nonyltridecanol, 2-decyltetradecanol, and the like. Examples of the Guerbet alcohols that are commercially available include the alcohols manufactured by Jarchem Industries, Inc., 40 Ball Street, Newark, N.J. 07105, and identified as Jarcol (I-12; I-16; I-1620; I-18; I-20; and I-24).

The relative amounts of each component of the fabric softener composition can be as follows: fabric softener (about 10 to 25 weight percent); polystyrene (about 40 to 60 weight percent); plasticizer (about 20 to 35 weight percent); and long chain alcohol (about 1 to 20 weight percent).

For those aspects or embodiments of this invention in which the fabric softener composition is incorporated into a substrate, any substrate which permits release of the fabric softener during the drying cycle can be used. Specific substrate forms include sheets, nonwoven webs, woven webs, pouches, sponges, and the like. Nonwoven webs include meltblown, spunbonded, airlaid, bonded-carded webs, and the like. Meltblown webs, particularly high melting temperature meltblown webs, are most preferred. It is also preferred, but not required, that the substrate contain a laundry detergent.

The amount of the fabric softener composition deposited onto the substrate is sufficient to soften clothes and can be from about 40 to about 230 grams per square meter of substrate surface area as viewed in two dimensions as a flat surface. Preferably, the amount is from about 130 to about 140 grams per square meter.

For purposes herein, the high melting temperature meltblown webs can be any meltblown web made from a thermoplastic polymer, including copolymers and polymer blends, having a melting point of 170° C. or greater, preferably about 200° C. or greater. A preferred polymer is poly(butylene terephthalate), which has a melting point of about 221° C. Also suitable are polycaprolactam (nylon 6), which melts at 220° C., poly(ethylene terephthalate), which melts at 250° C., and polymethyl pentene, which melts at 240° C. The process for making such meltblown webs is well known in the art and is used extensively for manufacturing a wide variety of commercial nonwoven products. A representative example of the meltblowing process is disclosed in U.S. Pat. No. 3,978,185 to Buntin et al. dated Aug. 31, 1976. For purposes of meltblowing, it is preferred that the apparent viscosity of the polymer as it leaves the die tip be about 500 poise or less, most preferably from about 150 to about 300 poise. Higher apparent viscosities provide low throughputs which are generally unsatisfactory for commercial operation. Increased throughputs can be achieved by lowering the apparent viscosity, which can be lowered either by lowering the molecular weight of the polymer or by raising the temperature of the polymer. It will be appreciated, however, that other meltblowing processes will also produce meltblown webs suitable for purposes of this invention. The meltblown web can be combined with or laminated to other supporting webs, such as spunbonded webs, in order to impart strength or other attributes to the product.

The basis weight for a single sheet of the meltblown webs of this invention can range from about 80 to about 300 grams per square meter. Preferably the basis weight will be from about 110 to about 250, and most preferably about 160 grams per square meter. Basis weights lower than the above-said range lack sufficient pore volume to hold the necessary amount of liquid detergent for a single wash load. Basis weights greater than the above-said range are too difficult to convert and are too costly. It is within the scope of this invention, however, to incorporate more than one ply of meltblown web into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during manufacture of meltblown webs by hot embossing or ultrasonic bonding of the newly formed web. The product can be dispensed in sheet form or from perforated rolls. In addition, the single sheets can be perforated to be torn in half for half loads of laundry.

The liquid detergents that can be incorporated into substrate for making the products of this invention can be any liquid detergents which are suitable for cleaning laundry. As is well known in the detergent arts, these detergents typically contain a large number of components such as surfactants, solubilizers, pH adjusters, fragrances, brighteners, dyes, anti-redeposition compounds, and builders. For purposes of processing, as will be explained herein, it is preferable that the liquid detergent contain at least 60 weight percent active detergent solids in order to minimize drying costs, although liquid detergents having at least 25 weight percent solids are suitable. The resulting condensed liquid detergent has a liquid detergent formulation solids content of about 80 weight percent or more.

The amount of active liquid detergent solids provided by the condensed liquid detergent must be at least 1 gram per gram of meltblown web, preferably from about 2 to about 5 grams per gram and most preferably from about 3 to about 4 grams per gram. The amount of active detergent solids retained by the meltblown web has been measured to be as high as about 12 grams per gram and will depend upon the detergent formulation, the extent to which it is condensed, the basis weight and area of the web, and the pattern bonding area of the web. The capacity of the web to hold detergent will decrease as the pattern bonding area is increased. Hence it is necessary to strike a balance between detergent capacity and web integrity during use. Generally, the pattern bonding area can range from about 5 to about 40 percent of the total surface area of the web, with from about 10 to about 20 percent being preferred, and about 15 percent being most preferred.

DETAILED DESCRIPTION OF THE INVENTION

Method for Measuring Static Reduction

Fabric softener effectiveness is commonly determined by measuring static electricity reduction. Many of these methods involve removing clothes from the dryer and hanging the clothes before any determination of static electricity is begun. Since it is known that the rate at which static electricity is dissipated is largely dependent upon the relative humidity of the surrounding air, the usefulness of this test is determined by the humidity of the ambient air on the day of the test. To circumvent this problem, the following method was developed.

A standard wash load containing four hand towels and three white polyester/cotton single bed sheets is cleaned by washing two times with either one-half cup of AATCC (American Association of Textile Colorists and Chemists) detergent or Tide ®. The load is stripped of any residual detergent by washing two more times without detergent. The damp test load is then dried in a home dryer equipped with a static charge measuring system as hereinafter described.

Static charge in the dryer is measured using a Fluck 8840 multimeter (voltmeter). One lead of the voltmeter is attached to a probe in the dryer and the other lead is attached to ground. The impedance of this Fluck 8840 multimeter is about 40 million ohms per volt. On command from a control, the voltmeter takes a reading of the voltage in the dryer. The Fluck meter has an IEEE 488 interface connected to an IBM personal computer. The computer is equipped with input/output boards, an IEEE 488 interface, an analog-to-digital converter board (A/D board) and an analog output board. The A/D board allows the computer to measure analog signals such as temperature. The analog output board allows the computer to actuate a set of relays.

The computer, under program control, takes readings of the static electricity three times a minute, as read from the voltmeter, and transmits the readings through the IEEE 488 interface. Each reading is stored as data in a file that can be read by Lotus ®. Before each reading can be made, the leads of the voltmeter are "shorted" together at a signal from computer to the analog output board. This "shorting" the leads together is required to drain any residual charge on the probe in the dryer before each reading is taken. After the voltmeter's leads are shorted, the computer "tells" the voltmeter to take a reading. This static reading is then stored on a floppy disk. At the same time, the computer determines the temperature and dew point of the dryer air. The dryer temperature is monitored by the use of a T-type thermocouple which is amplified by an EXP-16 board and fed into the A/D converter. This information allows the source of the dryer cycle to be followed. All the data is stored. The Lotus ® program retrieves the stored data between 36 to 57 minutes into the dryer cycle, sums it, and normalizes it for 60 readings. The normalized readings will then form a scale between 0 and 15.5 volts. A zero reading would be no static. A 15.5 reading would indicate no fabric softener on a very dry day.

EXAMPLE 1:

Preparation of Fabric Softener Composition

A mixture of 2.043 kilograms of Varisoft 136-100 fabric softener, 347 grams of isosteryl alcohol and 3.126 kilograms of dioctyl adipate was heated to 85° C. which was sufficient to melt the mixture. The mixture was stirred to produce a homogeneous liquid and allowed to cool and solidify.

The material was reheated and compounded with polystyrene pellets, using a one-inch twin screw extruder having a 24:1 length-to-diameter ratio and a 3 hp motor. The extruder was set to give a maximum amount of sheer mixing. The extruder had seven controllable heated zones. The first zone was a feeding section where 8103 grams of polystyrene pellets (Huntsmen 203) were added using a vibrating hopper. The second zone was a metering section. The first two zones were kept at 425 to 450° F. The next two zones contained mixing disks with the temperature kept about 400 to 410° F. The fifth zone contained a liquid injection port, where the molten mixture of fabric softener, long chain alcohol and plasticizer were added, and had a conveying screw to cut the pressure to atmospheric where the liquid was injected. The temperature of this section was usually 340° F. The remaining two zones contained high sheer kneading elements and were maintained at a temperature of about 250° F. While the extruder was in operation, the liquid add-in would typically back up to the third zone, which facilitated the mixing. Because the molten mixture was too soft to pelletize, the mixture leaving the extruder was allowed to cool in release-lined boxes.

EXAMPLE 2:

Applying Fabric Softener Composition to a Substrate

After the fabric softener composition had been compounded as described in Example 1, the material was applied to a nonwoven substrate. Because of the high viscosity of the formulation, rotary screen printing was used. With this method, the fabric softener composition was forced through a metal screen onto the substrate, the add-on amount being influenced by the viscosity of the composition and the amount of pressure applied by the blade that rides on the inside of the screen. The pattern applied to the substrate is determined by the pattern of the mesh openings in the screen. The temperature of the screen was precisely controlled so that the viscosity of the composition remained constant. In this example, the temperature of the screen was 380° F. The pump that pumped the composition on to the inside of the screen was operating at 45.5 rpm. The substrate was a meltblown web made of poly(butylene terephthalate) having a 15% bond area and a basis weight of about 165 grams per square meter. The fabric softener composition was coated on the web at 203 grams per square meter of area of the meltblown web.

EXAMPLE 3:

Fabric Softener Efficacy 400 square inches of the coated meltblown web as described in Example 2 was introduced into a dryer with a test load of damp laundry as described above. The resulting static level was 8.39 volts, as compared to about 14.5 volts for the same load with no static reduction aids present.

EXAMPLE 4:

Fabric Softener Efficacy 100 square inches of the substrate described in Example 2 was added to a dryer with a test load of damp laundry as described above. The 100 square inch piece reduced the static electricity value from 14.5 volts to 11.70 volts. When the coated substrate had first been washed with detergent in hot water in a home washing machine, the static value was 11.87. This result shows that this formulation released fabric softener in the dryer but released very little fabric softener in the washing cycle.

The foregoing examples, given for purposes of illustration, are not to be construed as limiting the scope of this invention, which is defined by the following claims.

We claim:

1. A fabric softener composition comprising a mixture of a fabric softener, polystyrene, a plasticizer and a long chain branched primary alcohol having a chain length of 8 carbon atoms or more, said fabric softener composition being effective to reduce static electricity while drying a load of laundry in a clothes dryer.

2. The fabric softener composition of claim 1, wherein the plasticizer is an ester of an aliphatic carboxylic acid.

3. The fabric softener composition of claim 2, wherein the ester is selected from the group consisting of dioctyl adipate, diisooctyl adipate and di-(2-ethylhexyl) adipate.

4. The fabric softener composition of claim 1, wherein the long chain alcohol is a long chain branched primary alcohol.

5. The fabric softener composition of claim 4, wherein the long chain alcohol is a Guerbet alcohol.

6. The fabric softener composition of claim 4, wherein the long chain alcohol is isostearyl alcohol.

7. A fabric softener composition comprising a mixture of a fabric softener, polystyrene, dioctyl adipate, and isotearyl alcohol, said fabric softener composition being effective to reduce static electricity while drying a load of laundry in a clothes dryer.

8. The fabric softener composition of claim 7 wherein the fabric softener is di-hydrogenated tallow dimethyl ammonium methyl sulfate.

9. A laundry cleaning product comprising a substrate supporting a coating of a fabric softener composition comprising a mixture of a fabric softener, polystyrene, a plasticizer, and a long chain alcohol having a chain length of 8 carbon atoms or greater.

10. The product of claim 9, wherein the substrate is a web.

11. The product of claim 9, wherein the substrate is a meltblown web.

12. The product of claim 11, wherein the meltblown web contains a liquid laundry detergent.

13. A laundry cleaning product comprising a meltblown web containing treated areas impregnated with a liquid laundry detergent and untreated areas where substantially no liquid laundry detergent is present, wherein said untreated areas of the web support a coating of a fabric softener composition comprising a mixture of a fabric softener, polystyrene, a plasticizer and a long chain branched primary alcohol having a chain length of 8 carbon atoms or more, said fabric softener composition being effective to reduce static electricity while drying a load of laundry in a clothes dryer.

14. The product of claim 13, wherein the fabric softener composition comprises a fabric softener, polystryene, dioctyl adipate and isostearyl alcohol.

15. A fabric softener composition a mixture of from about 10 to about 25 weight percent fabric softener, from about 40 to about 60 weight percent polystryene, from about 20 to about 35 weight percent plasticizer, and from about 1 to about 20 weight percent of a long chain branched primary alcohol having a chain length of 8 carbon atoms or greater.

16. A fabric softener composition comprising a mixture of from about 10 to about 25 weight percent fabric softener, from about 40 to about 60 weight percent polystyrene having a melt flow greater than 2.0 grams in 10 minutes, from about 20 to about 356 weight percent plasticizer, and from about 1 to about 20 weight percent of a long chain branched primary alcohol having a chain length of 8 carbon atoms or greater.

17. A fabric softener composition comprising a mixture of from about 10 to about 25 weight percent fabric softener, from about 40 to about 60 weight percent, polystyrene having a melt flow greater than 2.0 grams in 10 minutes, from about 20 to about 35 weight percent of an ester selected from the group consisting of dioctyl adipate, diisooctyl adipate and di-(2-ethylhexyl) adipate, and from about 1 to about 20 weight percent of isostearyl alcohol.

18. The fabric softener composition of claim 17 wherein the fabric softener is di-hydrogenated tallow dimethyl ammonium methyl sulfate.

19. A laundry cleaning product comprising a substrate supporting a coating of a fabric softener composition comprising a mixture of from about 10 to about 25 weight percent fabric softener, from about 40 to about 60 weight percent polystyrene, from about 20 to about 35 weight percent plasticizer, and from about 1 to about 20 weight percent of a long chain branched primary alcohol having a chain length of 8 carbon atoms or greater, all of said weight percents being based on the total weight of the fabric softener composition.

20. The product of claim 19 wherein the substrate is a web.

21. The product of claim 19 wherein the substrate is a meltblown web.

22. The product of claim 21 wherein the meltblown web contains a laundry detergent.

23. A laundry cleaning product comprising a web containing treated area impregnated with a liquid laundry detergent and untreated areas where substantially no laundry detergent is present on the surface of the web, wherein said untreated areas of the web support a coating of a fabric softener composition comprising a mixture of from about 10 to about 25 weight percent fabric softener, from about 40 to about 60 weight percent polystyrene, from about 20 to about 35 weight percent plasticizer, and from about 1 to about 20 weight percent of a long chain branched primary alcohol having a chain length of 8 carbon atoms or greater, all of said weight percents being based on the total weight of the fabric softener composition.

24. The product of claim 23 wherein the treated areas impregnated with laundry detergent are parallel strips spaced apart by strips of untreated areas.

25. A laundry cleaning product comprising a meltblown web containing treated areas impregnated with a liquid laundry detergent and untreated areas where substantially no laundry detergent is present on the surface of the web, wherein said untreated areas of the web support a coating of a fabric softener comprising a mixture of from about 10 to about 25 weight percent fabric softener, from about 40 to about 60 weight polystyrene having a melt flow of 2.0 grams or greater in 10 minutes, from about 20 to about 35 weight percent plasticizer, and from about 1 to about 20 weight percent of a long chain branched primary alcohol having a chain length of 8 carbon atoms or greater.

26. The product of claim 25 wherein the plasticizer is selected from the group consisting of dioctyl adipate, diisooctyl adipate and di-(2-ethylhexyl adipate.

27. The product of claim 26 wherein the long chain alcohol is isostearyl alcohol.

28. The product of claim 27 wherein the fabric softener is di-hydrogenate tallow dimethyl ammonium methyl sulfate.

29. The product of claim 28 wherein the treated areas impregnated with laundry detergent are parallel strips spaced apart by strips of untreated areas.

* * * * *

UNITED STATES PATENT AND TRADEMARK OFFICE

CERTIFICATE OF CORRECTION

PATENT NO. : 4,965,000

DATED : October 23, 1990

INVENTOR(S) : David C. Potts; Maug H. Win; Lee P. Garvey

It is certified that error appears in the above-identified patent and that said Letters Patent is hereby corrected as shown below:

Claim 15, line 1, after the word "composition" insert --comprising--.

Claim 17, line 3, delete "percent," and substitute therefor --percent--.

Claim 23, line 2, delete "area" and substitute therefor --areas--.

Signed and Sealed this

Fourth Day of August, 1992

*Attest:*

DOUGLAS B. COMER

*Attesting Officer*

*Acting Commissioner of Patents and Trademarks*